US009555961B2

(12) United States Patent
Hwang et al.

(10) Patent No.: US 9,555,961 B2
(45) Date of Patent: Jan. 31, 2017

(54) CONTAINER COMPRISING CORNER MEMBER INCORPORATING LOCK UNIT

(71) Applicants: VANPLUS CORPORATION, Seoul (KR); KOREA PALLET POOL CO., LTD., Seoul (KR)

(72) Inventors: Se In Hwang, Incheon (KR); Byong Yoon Suh, Seoul (KR)

(73) Assignees: VANPLUS CORPORATION, Seoul (KR); KOREA PALLET POOL CO., LTD., Seoul (KR)

( * ) Notice: Subject to any disclaimer, the term of this patent is extended or adjusted under 35 U.S.C. 154(b) by 0 days.

(21) Appl. No.: 14/654,306

(22) PCT Filed: Jan. 29, 2014

(86) PCT No.: PCT/KR2014/000861

§ 371 (c)(1),
(2) Date: Jun. 19, 2015

(87) PCT Pub. No.: WO2014/119933

PCT Pub. Date: Aug. 7, 2014

(65) Prior Publication Data

US 2015/0344223 A1 Dec. 3, 2015

(30) Foreign Application Priority Data

Jan. 29, 2013 (KR) ..... 10-2013-0009988
Jul. 11, 2013 (KR) ..... 10-2013-0081792

(51) Int. Cl.
*B65D 90/00* (2006.01)
*B65D 88/00* (2006.01)

(52) U.S. Cl.
CPC ..... *B65D 90/0013* (2013.01); *B65D 88/005* (2013.01); *B65D 90/0026* (2013.01)

(58) Field of Classification Search
CPC ..... B65D 90/0013; B65D 90/0026; B65D 88/005; B65D 90/002
(Continued)

(56) References Cited

U.S. PATENT DOCUMENTS 5,765,977 A 6/1998 Reynard
2009/0095763 A1 4/2009 Bederke

FOREIGN PATENT DOCUMENTS

CN 101024442 A 8/2007
CN 101027233 A 8/2007
(Continued)

OTHER PUBLICATIONS

International Search Report (PCT/ISA/210) mailed on Apr. 29, 2014, by the Korean Patent Office as the International Searching Authority for International Application No. PCT/KR2014/000861.
(Continued)

*Primary Examiner* — Stephen Castellano
(74) *Attorney, Agent, or Firm* — Buchanan Ingersoll & Rooney PC

(57) ABSTRACT

A container for transporting cargo includes: a corner member that is disposed at a lower corner of the container and includes an inner space and a bottom hole that is formed in a lower end portion of the corner member to communicate with the inner space; and a locking unit that is used to fasten two adjacent containers when a plurality of the containers are stacked in multiple stages, is movable between a storage position at which the locking unit is stored in the inner space of the corner member and a use position at which the locking unit protrudes to the outside through the bottom hole of the corner member, and fastens the two adjacent containers at the use position. The locking unit may be housed and easily stored in the inner space of the corner member to reduce the risk of being lost during storage.

16 Claims, 16 Drawing Sheets

(58) Field of Classification Search
USPC ..... 220/1.5, 23.4; 206/512, 511
See application file for complete search history.

(56) References Cited

FOREIGN PATENT DOCUMENTS

| | | | |
|---|---|---|---|
| CN | 101066724 | A | 11/2007 |
| CN | 101311081 | A | 11/2008 |
| CN | 101468742 | A | 7/2009 |
| CN | 2013808883 | Y | 1/2010 |
| JP | 59-075493 | U | 5/1984 |
| JP | 2011-230852 | A | 11/2011 |
| KR | 10-1998-0081661 | A | 11/1998 |
| KR | 10-0360389 | B1 | 5/2003 |
| TW | 387849 | B | 4/2000 |

OTHER PUBLICATIONS

Written Opinion (PCT/ISA/237) mailed on Apr. 29, 2014, by the Korean Patent Office as the International Searching Authority for International Application No. PCT/KR2014/000861.
Chinese Office Action issued by the Chinese Patent Office on Jul. 19, 2016 in corresponding Chinese Patent Application No. 201480006627.6 (8 pages).

CONTAINER COMPRISING CORNER MEMBER INCORPORATING LOCK UNIT

This application is the national stage (Rule 371) of PCT/KR2014/000861 filed Jan. 29, 2014.

TECHNICAL FIELD

The present invention relates to a container, and more particularly, to a container having a structure in which a locking unit may be housed in a corner member and thus may be easily stored and may not be at risk of being lost during storage.

BACKGROUND ART

A container, e.g., a freight container or a cargo container, is a quadrangular parallelepiped metal box that is often used to transport maritime cargo. As shown in FIG. 1, a plurality of containers, for example, upper and lower containers C1 and C2, need to be stacked in multiple stages during transport or storage.

In this case, conventional container-fastening devices 1 that are called twist locks are devices for fastening the upper container C1 with the lower container C2. As shown in FIG. 2, each of the conventional container-fastening devices 1 includes a main body 6, a first coupling member 7 that is provided on an upper end portion of the main body 6 to be rotatable between a locked position and an unlocked position and is detachably inserted into a bottom hole 4 that is formed in a bottom surface of a corner member 2 that is disposed at a lower corner of the upper container C1, and a second coupling member 8 that is provided on a lower end portion of the main body 6 to be rotatable between the locked position and the unlocked position and is detachably inserted into an insertion hole 5 that is formed in a top surface of a corner member 3 that is disposed at an upper corner of the lower container C2.

Assuming that the conventional container-fastening devices 1 are used, the upper and lower containers C1 and C2 are fastened to each other when a worker rotates the first coupling member 7 that is inserted into the bottom hole 4 and the second coupling member 8 that is inserted into the insertion hole 5 to the locked position, and in contrast, the upper and lower containers C1 and C2 are separated from each other when the worker rotates the first coupling member 7 and the second coupling member 8 to the unlocked position.

However, since the conventional container-fastening devices 1 are devices separate from the upper and lower containers C1 and C2, and thus are used when necessary after being separately stored apart from the upper and lower containers C1 and C2, it is inconvenient to store the conventional container-fastening devices 1 and there is a high risk of the conventional container-fastening devices 1 being lost during storage.

Also, since the first coupling member 7 and the second coupling member 8 have to be accurately disposed on and then respectively inserted into the bottom hole 4 and the insertion hole 5 of the corner members 2 and 3, it is not easy to fasten the upper and lower containers C1 and C2 of the conventional container-fastening devices 1, thereby increasing working hours.

DETAILED DESCRIPTION OF THE INVENTION

Technical Problem

The present invention provides a container having an improved structure in which a locking unit may be housed in an inner space of a corner member, and thus may be easily stored and may not be at risk of being lost during storage.

Technical Solution

According to an aspect of the present invention, there is provided a container for transporting cargo, the container including: a corner member that is disposed at a lower corner of the container and includes an inner space and a bottom hole that is formed in a lower end portion of the corner member to communicate with the inner space; and a locking unit that is used to fasten two adjacent containers when a plurality of the containers are stacked in multiple stages, is movable between a storage position at which the locking unit is stored in the inner space of the corner member and a use position at which the locking unit protrudes to the outside through the bottom hole of the corner member, and fastens the two adjacent containers at the use position.

The container may further include a handle having one end portion that is coupled to the locking unit and the other end portion that is disposed outside the corner member.

The handle may include at least one articulated joint portion so that the handle is freely bendable.

The container may further include a position fixing unit for fixing a position of the locking unit that is located at the storage position.

The position fixing unit may include: a first fixing portion that is a groove formed in the corner member; and a second fixing portion that is a cut portion formed on the handle to be detachably coupled to the first fixing portion.

The locking unit may include: a main body that is unrotatably inserted into the bottom hole of the corner member; and a coupling member having one end portion that is rotatably mounted on the main body and the other end portion that, when the other end portion is inserted into an insertion hole of an adjacent container, is rotatable about a central axis between a locked position at which the other end portion is inseparable from the insertion hole and an unlocked position at which the other end portion is separable from the insertion hole, wherein a rotation position of the coupling member is fixed at the locked position.

Inclined surfaces may be formed on the other end portion of the coupling member so that the coupling member is easily inserted into the insertion hole of the adjacent container.

The coupling member may be formed so that when the locking unit is located at the use position, the other end portion of the coupling member that protrudes to the outside through the bottom hole of the corner member is not re-inserted into the inner surface of the corner member through the bottom hole of the corner member.

The rotation position of the coupling member may be fixed at a point between the locked position and the unlocked position.

The container may further include an opening through which the locking unit is inserted into the inner space of the corner member.

The coupling member may move reciprocally along the central axis between an insertion position at which the coupling member is introduced into the main body and a protrusion position at which the coupling member protrudes downward from the main body.

A reciprocation position of the coupling member along the central axis may be fixed at the insertion position and the protrusion position.

The main body may include one pair of housing members having cut surfaces that face each other, wherein a position fixing projection projects from one of the cut surfaces and a position fixing groove that is concave and into which the position fixing projections is inserted is formed in the remaining cut surface.

When the coupling member is located at the locked position and the main body is unrotatably inserted into the bottom hole of the corner member, the main body may be unrotatably inserted into the insertion hole of the adjacent container.

When the coupling member is located at the locked position and the main body is unrotatably inserted into the bottom hole of the corner member, the main body may maintain contact with an inner circumferential surface of the bottom hole of the corner member and with an inner circumferential surface of the insertion hole of the adjacent container.

Pressing ball receiving grooves that are spaced apart from one another by a preset angle along the central axis may be formed in an outer circumferential surface of the coupling member, wherein the container further includes: pressing balls that are spherical members for pressing the outer circumferential surface of the coupling member, are disposed to move reciprocally along pressing ball moving holes that are formed in the main body, and may be received in the pressing ball receiving grooves; springs that are elastic members for elastically biasing the pressing balls toward the outer circumferential surface of the coupling member; and caps that are members for closing outer end portions of the pressing ball moving holes.

The main body may include one pair of housing members having cut surfaces that face each other, wherein the caps project from the cut surface of one of the one pair of housing members, and cap receiving grooves in which the caps are received are formed in the cut surface of the remaining housing member.

One end portion of the handle may be coupled to an upper end portion of the locking unit, and the other end portion of the handle may be formed so that the handle rotates upward with respect to the at least one articulated joint portion and does not rotate downward with respect to the at least one articulated joint portion.

Advantageous Effects

According to the present invention, since a container includes a corner member that is disposed at a lower corner of the container and includes a bottom hole formed in a lower end portion to communicate with an inner space, and a locking unit is movable between a storage position at which the locking unit is stored in the inner space of the corner member and a use position at which the locking unit protrudes to the outside through the bottom hole of the corner member and is used to fasten one pair of containers at the use position, unlike a conventional container having a structure in which container-fastening devices have to be separately stored apart from containers, the locking unit may be housed and stored in the inner space of the corner member, and thus may be easily stored and may not be at risk of being lost during storage.

BEST MODE

The present invention will now be described more fully with reference to the accompanying drawings, in which exemplary embodiments of the invention are shown.

Figure 1:
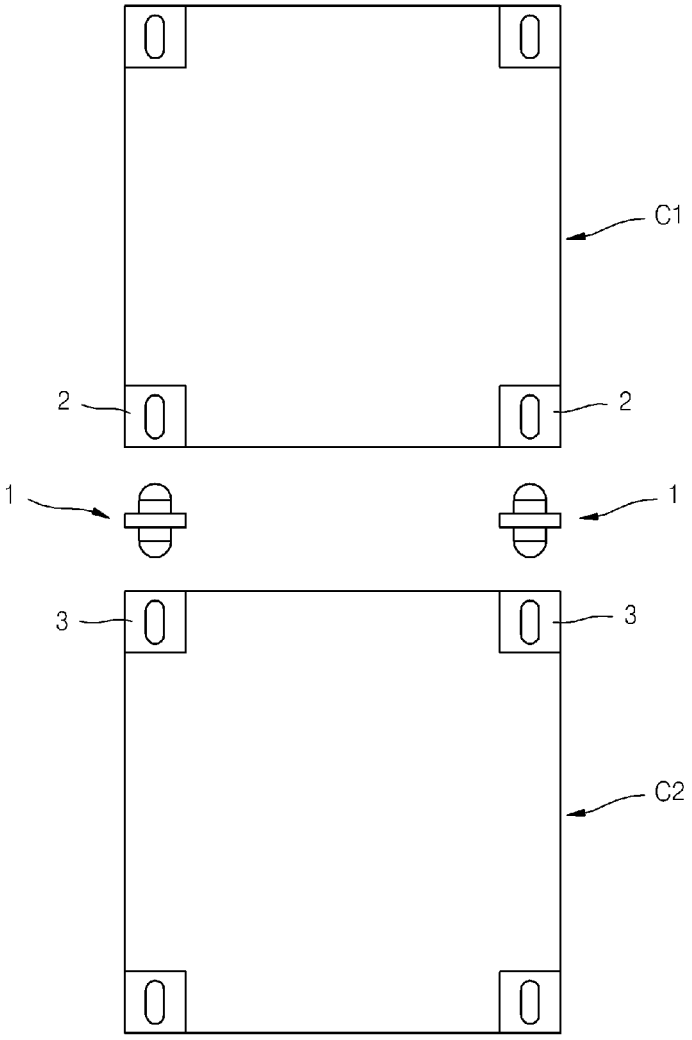
FIG. 1 is a view for explaining conventional container-fastening devices.
Figure 2:
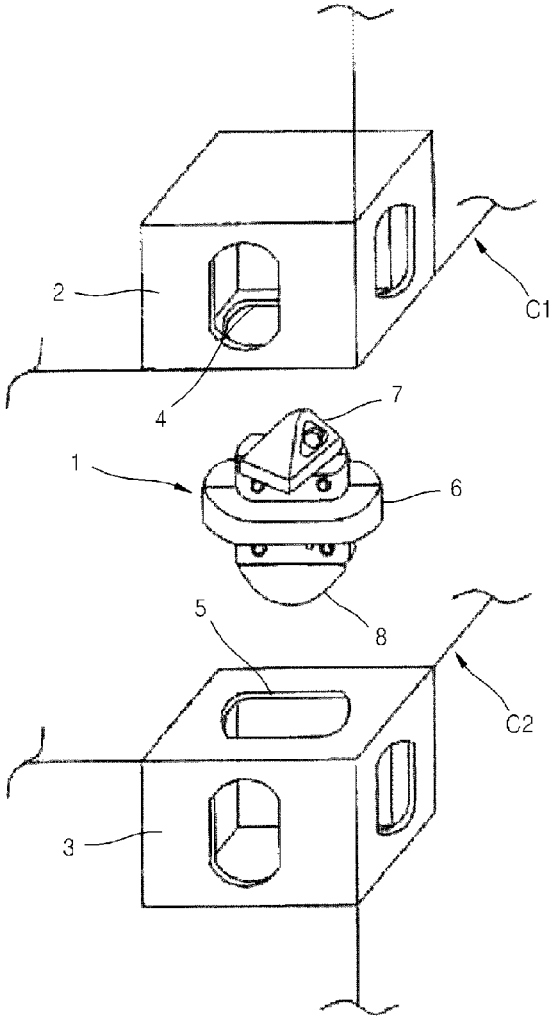
FIG. 2 is a partial enlarged view of one of the conventional container-fastening devices of FIG. 1.
Figure 3:
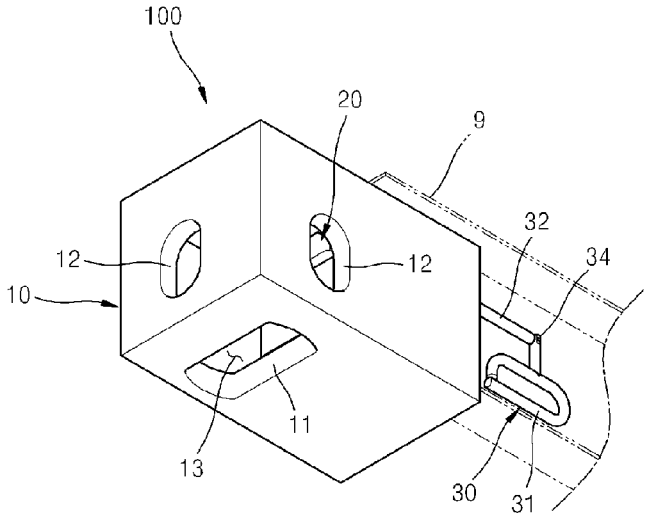
FIG. 3 is a perspective view of a corner member of a container according to an exemplary embodiment of the present invention.
Figure 4:
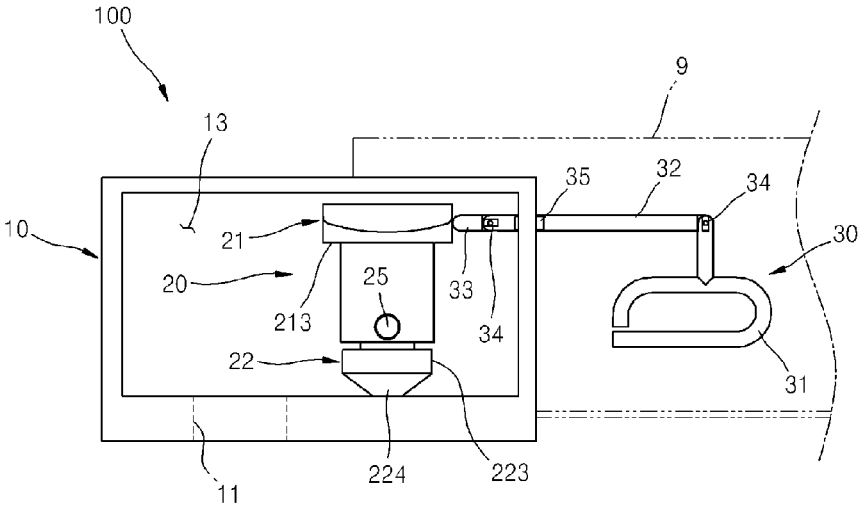
FIG. 4 is a partially cut front view illustrating the inside of the corner member of FIG. 3.
Figure 5:
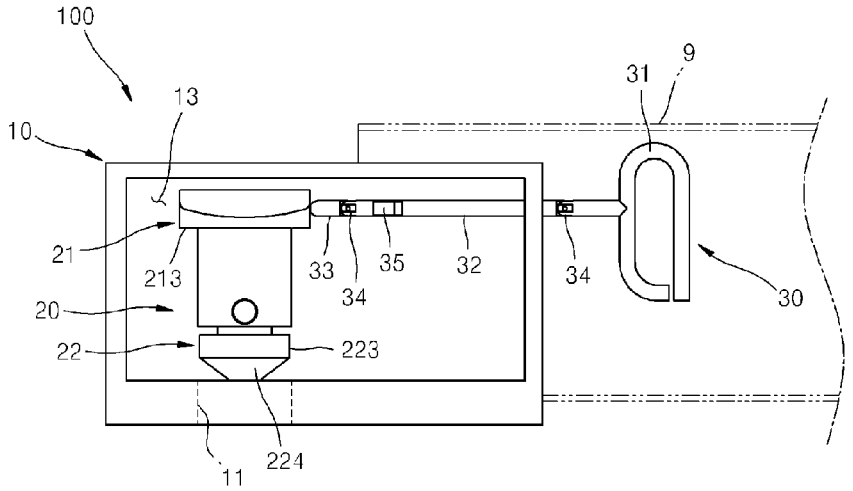
FIG. 5 is a view illustrating a state where a locking unit of FIG. 4 moves leftward in an inner space of the corner member.

FIG. 3 is a perspective view of a corner member 10 of a container 100 according to an exemplary embodiment of the present invention. FIG. 4 is a partially cut front view illustrating the inside of the corner member 10 of FIG. 3. FIG. 5 is a view illustrating a state in which a locking unit 20 of FIG. 4 moves leftward in an inner space 13 of the corner member 10.

Referring to FIGS. 3 through 5, the container 100 according to an exemplary embodiment of the present invention, e.g., a cargo container, includes the corner member 10, the locking unit 20, and a handle 30.

The corner member 10 that is a quadrangular parallelepiped metal member mounted at each of four corners of the container 100 includes a bottom hole 11, a side hole 12, and the inner space 13. In the present exemplary embodiment, the corner member 10 is manufactured to have a box shape by welding six metal plates and is welded to an end portion of a lower frame 9 of the container 100.

The bottom hole 11 that is an oval hole formed in a bottom surface of the corner member 10 has a shape defined by international standards.

The side hole 12 that is an oval hole formed in an outer surface of the corner member 10 has a shape defined by the international standards. Two side holes 12 are formed in the present exemplary embodiment.

The inner space 13 that is formed inside the corner member 10 communicates with the bottom hole 11 and the side holes 12.

When the locking unit 20 is stored on the right of the inner space 13 of the corner member 10 as shown in FIG. 4, the inner space 13 has a horizontal length great enough for a separate twist lock that is similar to a first coupling member 7 to be inserted into the inner space 13 from the outside through the bottom surface 11.

Figure 18:
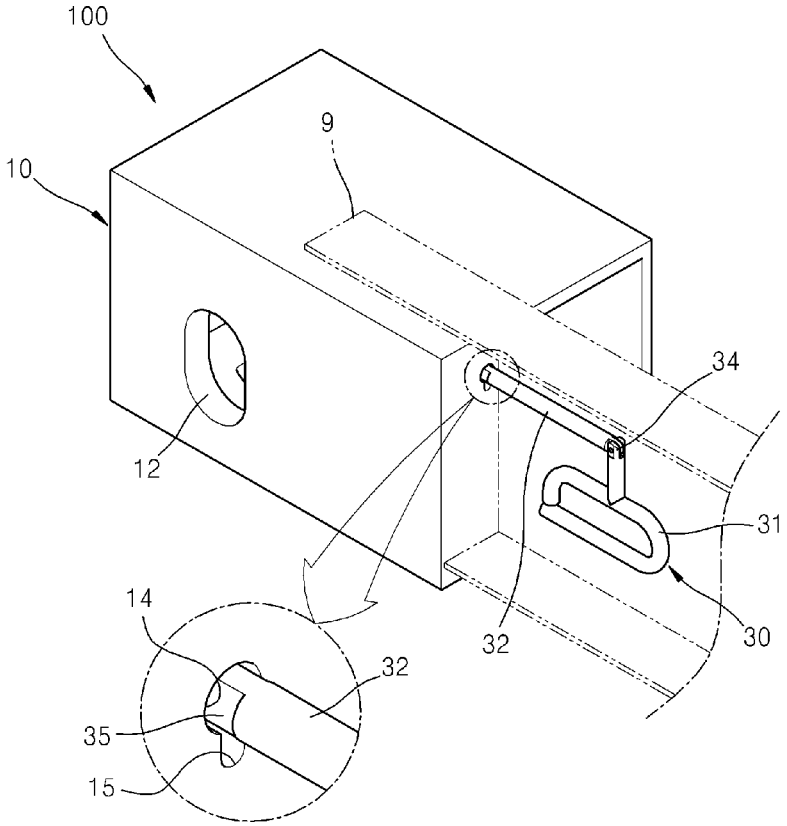
FIG. 18 is a perspective view of the corner member of FIG. 3, seen at a different angle.

A circular through-hole 14 through which the handle 30 passes is formed in a rear surface of the corner member 10 as shown in FIG. 18.

A first fixing potion 15 that is a groove extending downward is formed in a lower end portion of the through-hole 14.

Figure 19:
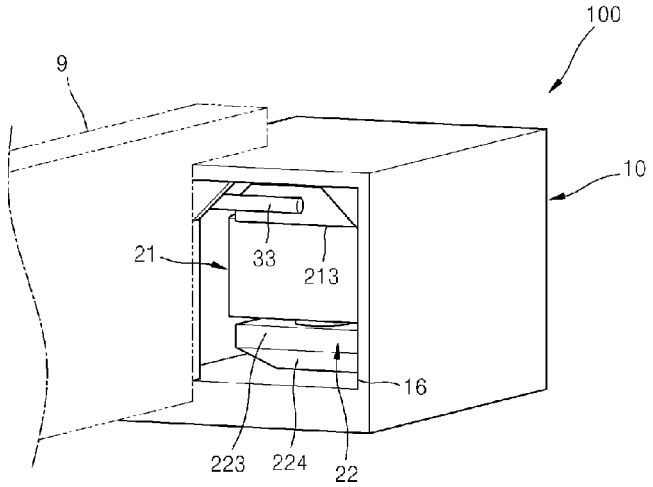
FIG. 19 is a rear perspective view of the corner member of FIG. 3.

An opening 16 for inserting the locking unit 20 into the inner space 13 of the corner member 10 is formed in the rear surface of the corner member 10 as shown in FIG. 19.

Although the inside of the container 100 that is completely manufactured is shown through the opening 16, the opening 16 is closed by using an appropriate unit later.

The locking unit 20 that is a locking device used to fasten two adjacent containers, for example, upper and lower containers C1 and C2, when a plurality of the containers 100, e.g., cargo containers, are vertically stacked in multiple stages is mounted in the inner space 13 of the corner member 10.

The locking unit 20 is movable between a storage position at which the locking unit 20 is stored in the inner space 13 of the corner member 10 and a use position at which a lower end portion of the locking unit 20 protrudes to the outside through the bottom hole 11 of the corner member 10.

In the present exemplary embodiment, the storage position of the locking unit 20 refers to a position at which the locking unit 20 is stored on the right of the inner space 13 of the corner member 10, as shown in FIG. 4.

Figure 6:
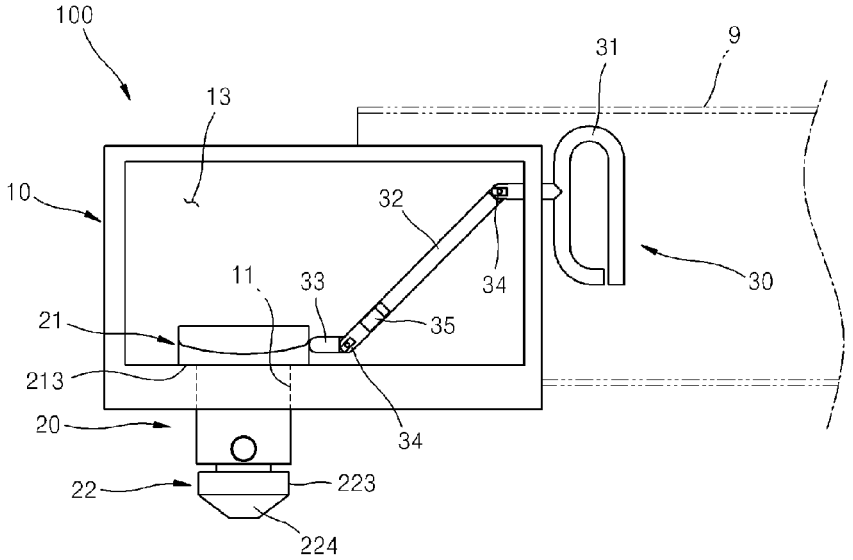
FIG. 6 is a view illustrating a state where the locking unit of FIG. 5 protrudes downward through a bottom hole of the corner member.
Figure 7:
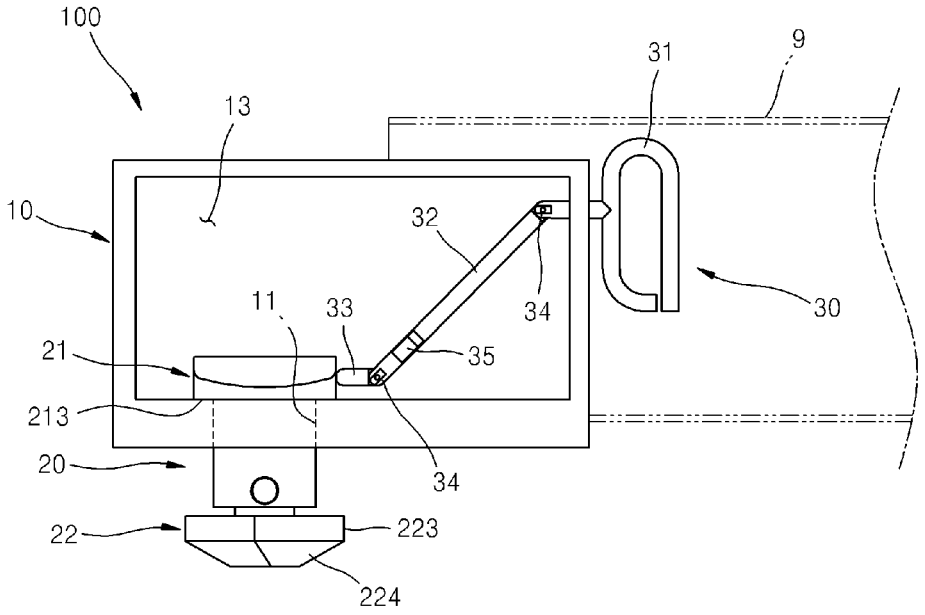
FIG. 7 is a view illustrating a state where a rotation position of a coupling member of the locking unit of FIG. 6 is fixed at a point between a locked position and an unlocked position.

In the present exemplary embodiment, the use position of the locking unit 20 refers to a position at which the locking unit 20 moves leftward in the inner space 13 of the corner member 10 as shown in FIG. 5, and then the locking unit 20 moves downward and the lower end portion of the locking unit 20 protrudes to the outside through the bottom surface 11 of the corner member 10 as shown in FIG. 6.

The locking unit 20 includes a main body 21, a coupling member 22, pressing balls 23, springs 24, and caps 25.

The main body 21 is a housing that may be unrotatably inserted into the bottom hole 11 of the corner member 10.

Protrusions 213 that extend outward to be placed over the bottom hole 11 of the corner member 10 are formed on both sides of an upper end portion of the main body 21.

A head receiving groove 211 that is horizontally formed to have a circular disc shape is formed inside the main body 21.

A connector receiving hole 214 that is a circular hole vertically extending to the head receiving groove 211 is formed in a lower end surface of the main body 21.

Pressing ball moving holes 212 that are circular holes communicating with the connector receiving hole 214 are formed in both outer circumferential surfaces of a lower end portion of the main body 21 to elongate inward.

Figure 12:
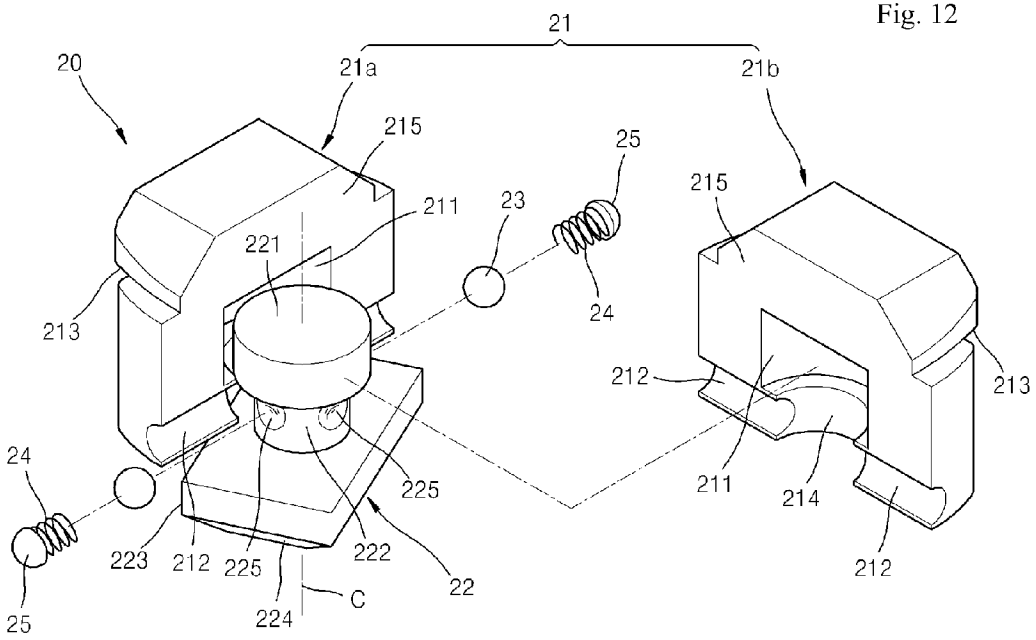
FIG. 12 is an exploded perspective view of the locking unit of FIG. 4.
Figure 13:
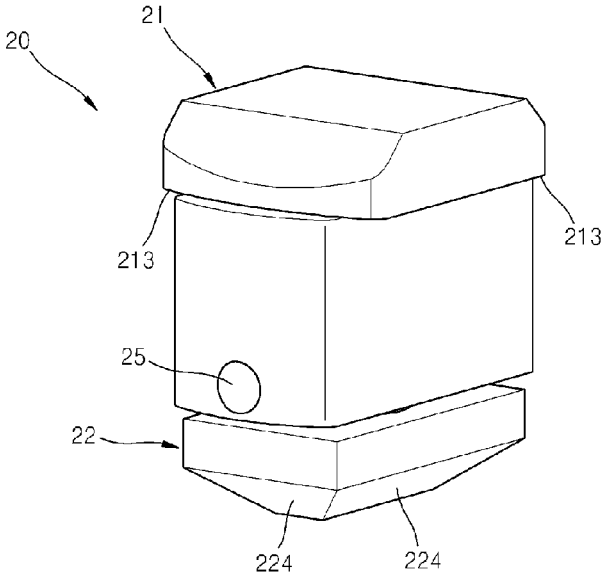
FIG. 13 is an assembled perspective view of the locking unit of FIG. 4.

In the present exemplary embodiment, the main body 21 is formed as two housing members 21*a* and 21*b* that are manufactured to have corresponding shapes are screwed with each other so that cut surfaces 215 that are vertically formed face each other, as shown in FIG. 12. The cut surfaces 215 are formed to halve the head receiving groove 211, each of the pressing ball moving holes 212, and the connector receiving hole 214.

Figure 10:
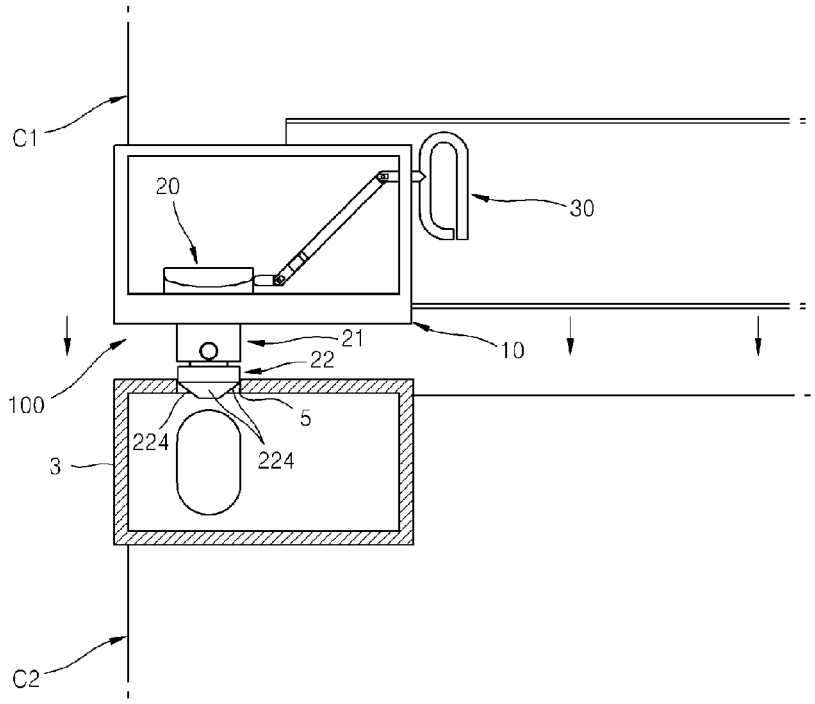
FIG. 10 is a view illustrating a state where the coupling member of the locking unit of FIG. 9 is inserted into an insertion hole of the lower container and rotates by a preset angle.

The coupling member 22 that is inserted into an insertion hole 5 of a corner member 3 of the lower container C2 as shown in FIG. 10 includes a head 221, a connector 222, and a coupling portion 223.

The head 221 that has a circular disc shape having a central axis C as its center is inseparably mounted in the head receiving groove 211 of the main body 21 that is provided on an upper end portion of the coupling member 22.

The head 221 is rotatably mounted in the head receiving groove 211 of the main body 21.

The connector 222 that has a circular cylindrical shape having the central axis C as its center elongates downward from a bottom surface of the head 221.

Four pressing ball receiving grooves 225 are formed at intervals of 90° along an outer circumferential surface of the connector 222.

Figure 17:
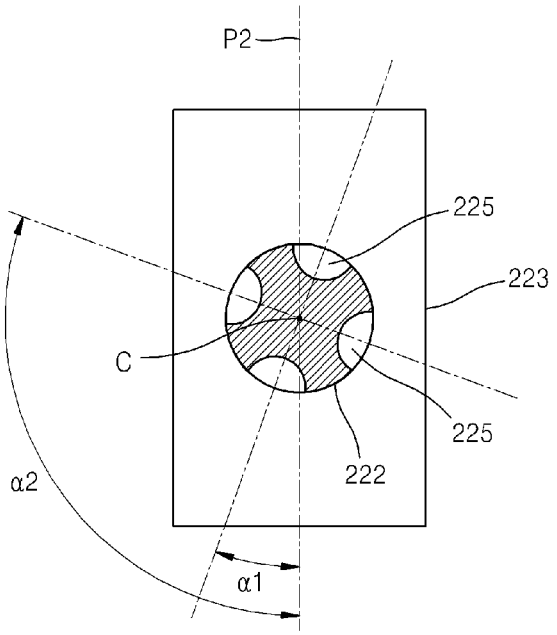
FIG. 17 is a horizontal cross-sectional view of the coupling member of the locking unit of FIG. 12.

The pressing ball receiving grooves 225 that have corresponding hemispherical shapes to receive the pressing balls 23 therein are formed at angles al that are preset from a central axis P2 of the coupling portion 223, as shown in FIG. 17. The angle $\alpha 1$ may range from about 10° to about 30°, and the angle $\alpha 1$ is 15° in the present exemplary embodiment.

The coupling portion 223 that has a corresponding rectangular shape to be inserted into the insertion hole 5 of the corner member 3 of the lower container C2 is provided at a lower end of the connector 222.

Figure 11:
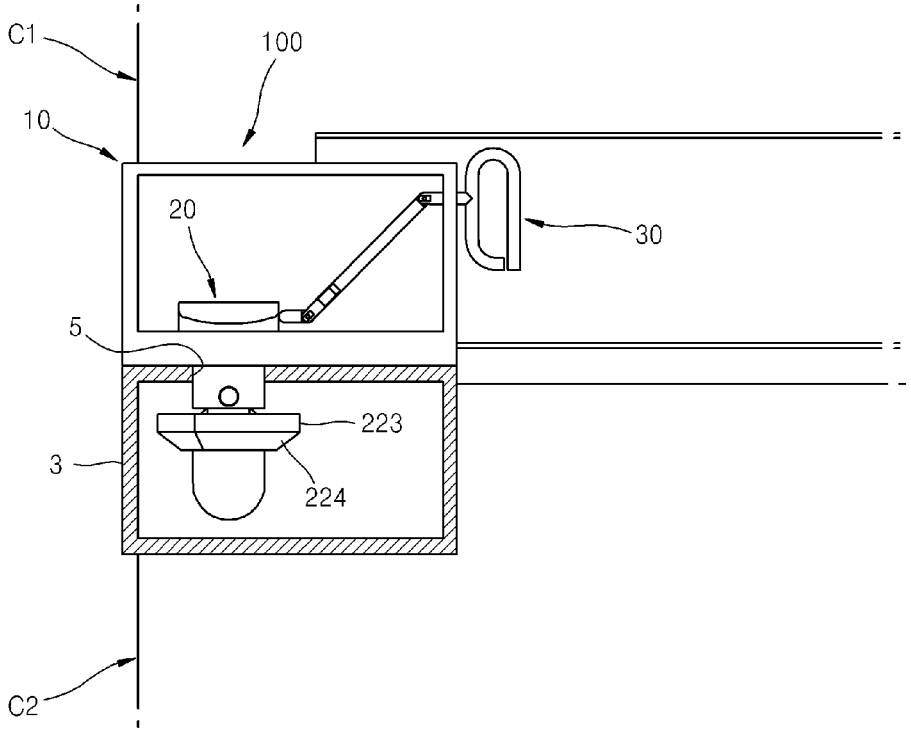
FIG. 11 is a view illustrating a state where the coupling member of the locking unit of FIG. 9 is inserted into the insertion hole of the lower container and rotates to the locked position, and thus a position of the coupling member is fixed.
Figure 14:
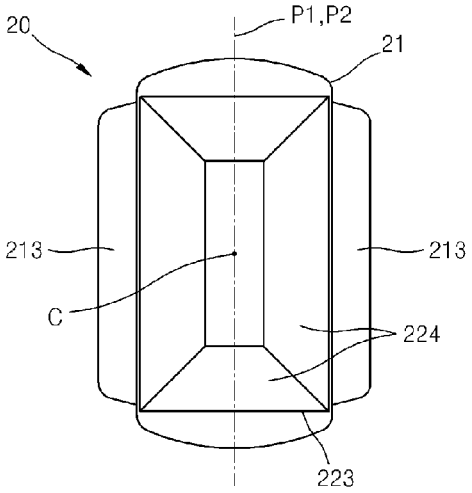
FIG. 14 is a bottom view illustrating a state where the coupling member of the locking unit of FIG. 13 is located at the unlocked position without rotating with respect to a main body.
Figure 16:
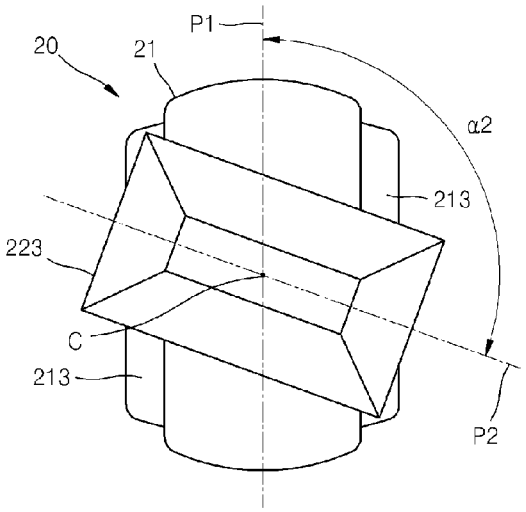
FIG. 16 is a view illustrating a state where the coupling member of the locking unit of FIG. 15 rotates by a preset angle with respect to the main body so that a position of the coupling member is fixed at the locked position.

When the coupling portion 223 is inserted into the insertion hole 5 of the corner member 3 of the lower container C2, the coupling portion 223 is rotatable between a locked position at which the coupling portion 223 is inseparable from the insertion hole 5 and an unlocked position which the coupling portion 223 is separable from the insertion hole 5. The locked position refers to a position at which a central axis P1 of the main body 21 and the central axis P2 of the coupling portion 223 have an angle $\alpha 2$ that is preset between the central axis P1 and the central axis P2 as shown in FIGS. 11 and 16, and the unlocked position refers to a position at which the central axis P1 of the main body 21 and the central axis P2 of the coupling portion 223 are parallel to each other as shown in FIGS. 6 and 14, and the angle $\alpha 2$ is 105° in the present exemplary embodiment.

Figure 8:
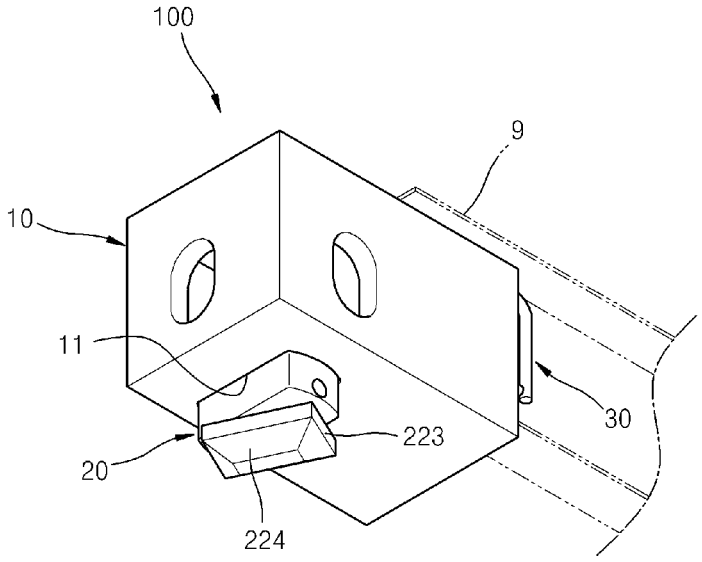
FIG. 8 is a perspective view of the corner member and the locking unit of FIG. 7.

A plurality of inclined surfaces 224 are formed on a bottom surface of the coupling portion 223 so that the coupling portion 223 is easily inserted into the insertion hole 5 of the lower container C2, as shown in FIG. 8.

Figure 9:
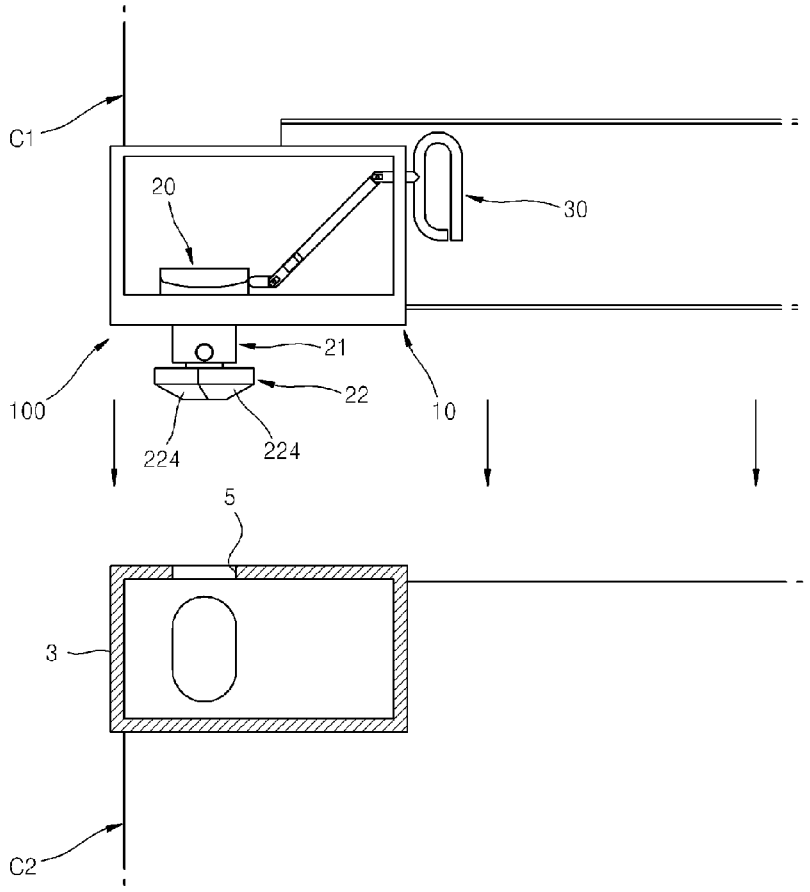
FIG. 9 is a view illustrating a state where an upper container on which the corner member and the locking unit of FIG. 7 are mounted is located over a lower container and is lowered.

The inclined surfaces 224 are provided so that the bottom surface of the coupling portion 223 is curved downward, and are guided by the insertion hole 5 when the inclined surfaces 224 contact edges of the insertion hole 5 of the lower container C2 as shown in FIGS. 9 and 10. In this case, the coupling portion 223 may rotate from a state of FIG. 15 to a state of FIG. 14.

The pressing balls 23 that are spherical members for pressing the outer circumferential surface of the connector 222 may be received in the pressing ball receiving grooves 225, and are disposed to reciprocate along the pressing ball moving holes 212.

The springs 24 that are elastic members for elastically biasing the pressing balls 23 toward the outer circumferential surface of the connector 222 are coil springs in the present exemplary embodiment.

The caps 25 that are members for closing outer end portions of the pressing ball moving holes 212 have inner surfaces that contact one end portions of the springs 24.

Accordingly, once the pressing balls 23 are received in the pressing ball receiving grooves 225, the pressing balls 23 closely contact the pressing ball receiving grooves 225 due to the springs 24. Since the pressing balls 23 are not separated from the pressing ball receiving grooves 225 unless the connector 222 rotates due to an external force, a position (referred to as a 'rotation position') of the coupling member 22 that rotates relative to the main body 21 is fixed.

Figure 15:
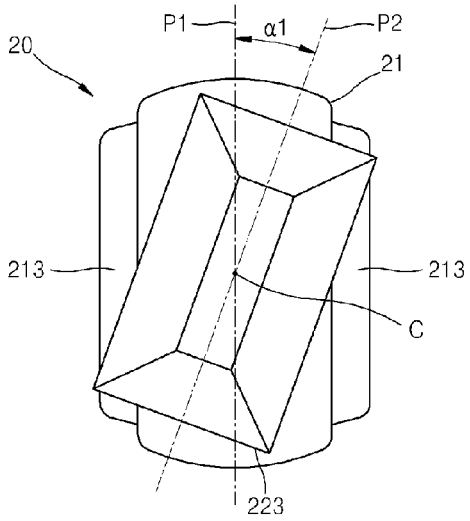
FIG. 15 is a view illustrating a state where the coupling member of the locking unit of FIG. 14 rotates by a predetermined angle with respect to the main body so that a position of the coupling member is fixed at a point between the locked position and the unlocked position.

As a result, since the rotation position of the coupling member 22 is fixed at each interval of 90°, the rotation position of the coupling member 22 may be fixed at the locked position as shown in FIG. 16, and may be fixed at a point between the locked position and the unlocked position as shown in FIG. 15. However, when the rotation position is fixed, it means that the coupling position 22 does not rotate when an external force that is equal to or less than a force at a preset level is applied and rotates when an external force that is greater than the force at the preset level is applied.

The handle 30 that is used by a worker to move the locking unit 20 has one end portion that is inserted into the inner space 13 of the corner member 10 and is coupled to the locking unit 20 and the other end portion that is disposed outside the corner member 10. The handle 30 includes a holding portion 31, an extending portion 32, a terminal portion 33, articulated joint portions 34, and a second fixing portion 35.

The holding portion 31 that is a ring-shaped member held by a worker's hand is disposed outside the corner member 10.

The extending portion 32 that is a straight long rod member has one end portion that is connected to the holding portion 31.

The extending portion 32 is disposed to pass through the through-hole 14 that is formed in the corner member 10 and may move reciprocally along the through-hole 14.

The second fixing portion 35 that is a cut portion having a corresponding shape is formed on the other end portion of the extending portion 32 to be detachably inserted into the first fixing portion 15 that is formed in the corner member 10.

In the present exemplary embodiment, a position fixing unit for fixing a position of the locking unit 20 that is located at the storage position at the corner member 10 is provided. The position fixing unit includes the first fixing portion 15 and the second fixing portion 35.

The terminal portion 33 that is a "L"-shaped rod member has one end portion that is connected to the other end portion of the extending portion 32 and the other end portion that is welded to the main body 21 of the locking unit 20.

The articulated joint portions 34 that are hinge structures that may be freely bent are disposed at a connection point between the holding portion 31 and the extending portion 32 and a connection point between the extending portion 32 and the terminal portion 33.

A method of using the container 100 constructed as described above will now be explained.

First, when the locking unit 20 is located at the storage position as shown in FIG. 4 and the second fixing portion 35 of the handle 30 is inserted into the first fixing portion 15 of the corner member 10 as shown in FIG. 18, the locking unit 20 that is located at the storage position does not move in the inner space 13 of the corner member 10 and a state (referred to as a position-fixed state) in which a position of the locking unit 20 is fixed is maintained.

In the position-fixed state, when the upper and lower containers C1 and C2 are to be fastened to each other, the worker separates the second fixing portion 35 of the handle 30 from the first fixing portion 15 of the corner member 10 as shown in FIG. 18 by holding and slightly lifting the holding portion 31 of the handle 30.

Next, when the workers pushes the holding portion 31 inward, the locking unit 20 horizontally moves leftward in the inner space 13 of the corner member 10 as shown in FIG. 5, and the locking unit 20 moves downward through the bottom hole 11 of the corner member 10 due to its gravity to the use position at which the lower end portion of the locking unit 20 protrudes to the outside as shown in FIG. 6. In this case, a state in which the main body 21 of the locking unit 20 is unrotatably inserted into the bottom hole 11 of the corner member 10 is maintained, and the protrusions 213 are placed over the bottom hole 11 in order for the main body 21 not to drop through the bottom hole 11.

Next, the worker rotates the coupling portion 223 with his/her hand by the angle $\alpha 1$, and the rotation position of the coupling member 22 is fixed at a point between the locked position and the unlocked position as shown in FIGS. 8 and 15.

After the locking unit 20 that is mounted on the upper container C1 is manually operated as described above, when the upper container C1 is located over the lower container C2 and is slowly lowered as shown in FIG. 9, the inclined surfaces 224 of the coupling portion 223 contact the edges of the insertion hole 5 of the corner member 3 of the lower container C2, and thus the coupling potion 223 rotates to the unlocked position as shown in FIGS. 10 and 14 and the main body 21 of the locking unit 20 is unrotatably inserted into the insertion hole 5.

Finally, when the worker rotates the coupling portion 223 with his/her hand to the locked position as shown in FIG. 11, the two adjacent containers, that is, the upper and lower containers C1 and C2, are completely fastened to each other.

A method of unfastening the upper and lower containers C1 and C2 is performed in the opposite order to that of the method of fastening the upper and lower containers C1 and C2, and thus a detailed explanation thereof will not be given.

Since the container 100 constructed as described above includes the corner member 10 that is disposed at a lower corner of each of the upper and lower containers C1 and C2 and includes the bottom hole 11 formed in a lower end portion to communicate with the inner space 13, and the locking unit 20 that is movable between the storage position at which the locking unit 20 is stored in the inner space 13 of the corner member 10 and the use position at which the locking unit 20 protrudes to the outside through the bottom hole 11 of the corner member 10 and is used to fasten the upper and lower containers C1 and C2 at the use position, unlike a conventional container having a structure in which container-fastening devices 1 have to be separately stored apart from the upper and lower containers C1 and C2, the locking unit 20 may be housed and stored in the inner space 13 of the corner member 10, and thus may be easily stored and may not be at risk of being lost during storage.

Since the container 100 includes the handle 30 having one end portion that is coupled to the locking unit 20 and the other end portion that is disposed outside the corner member 10, the worker may easily move the locking unit 20 by using the handle 30.

Also, since the container 100 includes one or more articulated joint portions 34 in order for the handle 30 to be freely bent, even when the locking unit 20 horizontally or vertically moves, a position of the other end portion of the handle 30 may be fixed within a preset range.

Also, since the container 100 includes the position fixing unit, that is, the first and second fixing portions 15 and 35, for fixing a position of the locking unit 20 that is located at the storage position, the locking unit 20 that is located at the storage position may be maintained in the position-fixed state without moving in the inner space 13 of the corner member 10, and thus there is no noise caused by the locking unit 20 and no damage to the locking unit 20.

Also, since the position fixing unit of the container 100 includes the first fixing portion 15 that is a groove formed in the corner member 1 and the second fixing portion 35 that is a cut position formed on the handle 30 to be detachably inserted into the first fixing portion 15, the position fixing unit may be may be realized by using simple machining without using a separate member.

Also, since the locking unit 20 of the container 100 includes the main body 21 that is unrotatably inserted into the bottom hole 11 of the corner member 10, and the coupling member 22 that has one end portion that is rotatably mounted on the main body 21 and the other end portion that is rotatable between the locked position at which the coupling member 22 is inseparable from the insertion hole 5 and the unlocked position at which the coupling member 22 is separable from the insertion hole 5 when the coupling member 22 is inserted into the insertion hole 5 of the lower container C2 that is an adjacent container, wherein the rotation position of the coupling member 22 may be fixed at the locked position, when the locking unit 20 is located at the use position as shown in FIG. 6, the worker may easily rotate the coupling member 22 at any of various angles with respect to the main body 21, and when the coupling member 22 that is inserted into the insertion hole 5 of the lower container C2 is rotated to the locked position as shown in FIG. 11, the coupling member 22 may not be easily separated from the insertion hole 5.

Also, since the container 100 includes the inclined surfaces 224 that are formed on the other end portion of the coupling member 22 so that the coupling member 22 is easily inserted into the insertion hole 5 of the lower container C2, when the inclined surfaces 224 contact the edges of the insertion hole 5 of the lower container C2 as shown in FIG. 10, the coupling member 22 may be guided by the insertion hole 5.

Also, since the rotation position of the coupling member 22 of the container 100 is fixed at the angle $\alpha 1$ between the locked position and the unlocked position as shown in FIGS. 9 and 15, when the upper container C1 is slowly lowered toward the lower container C2, even though positions of the coupling member 22 and the insertion hole 5 of the lower container C2 do not accurately correspond to each other and thus the coupling member 22 contacts another portion of the lower container C2, the coupling portion 223 that is exposed to the outside of the bottom hole 11 is not re-inserted into the inner space 13 of the corner member 10 through the bottom hole 11 of the corner member 10.

Also, since the container 100 includes the opening 16 that is formed in the rear surface of the corner member 10 as shown in FIG. 19, the locking unit 20 may be easily inserted into and mounted in the inner space 13 of the corner member 10.

Figure 20:
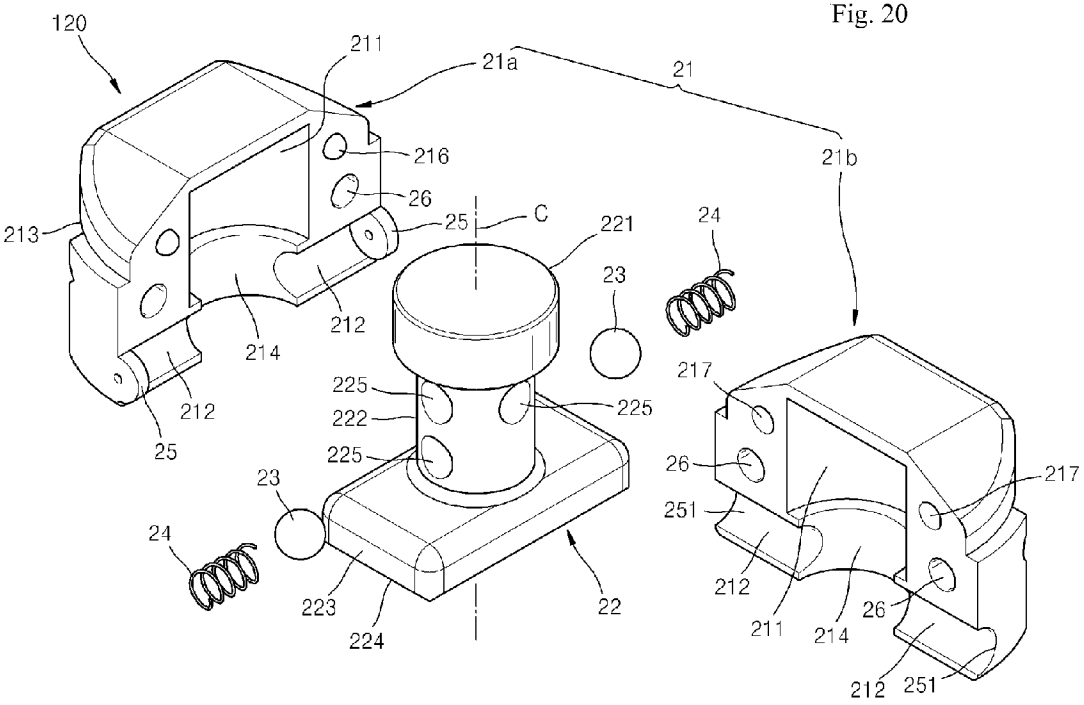
FIG. 20 is an exploded perspective view of a locking unit of a container according to another exemplary embodiment of the present invention.
Figure 21:
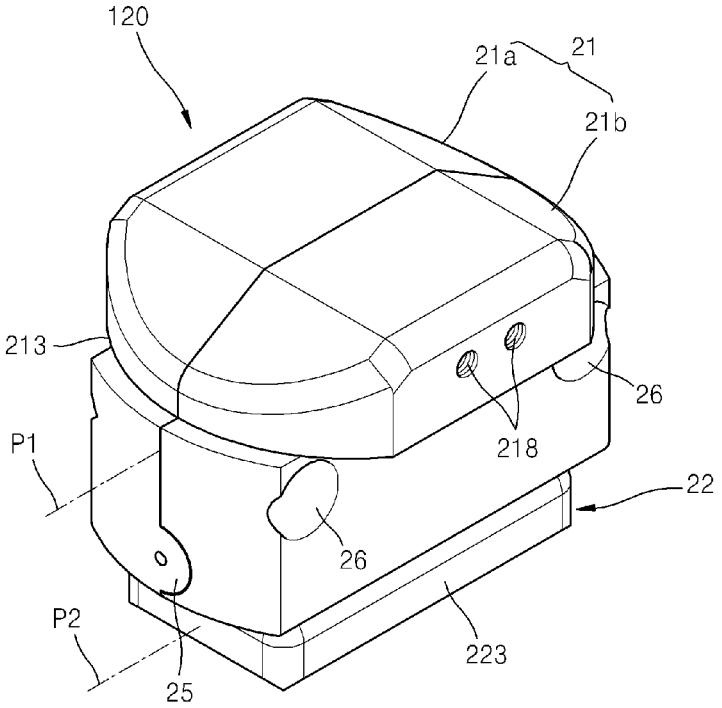
FIG. 21 is an assembled perspective view of the locking unit of FIG. 20.
Figure 22:
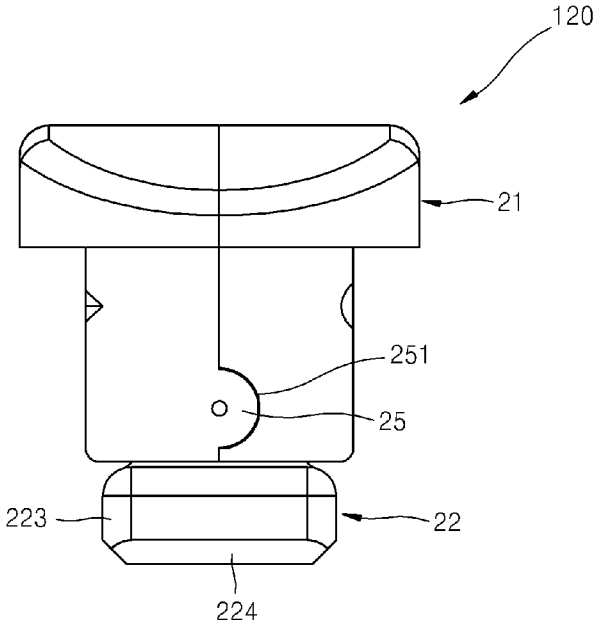
FIG. 22 is a front view of the locking unit of FIG. 21.
Figure 23:
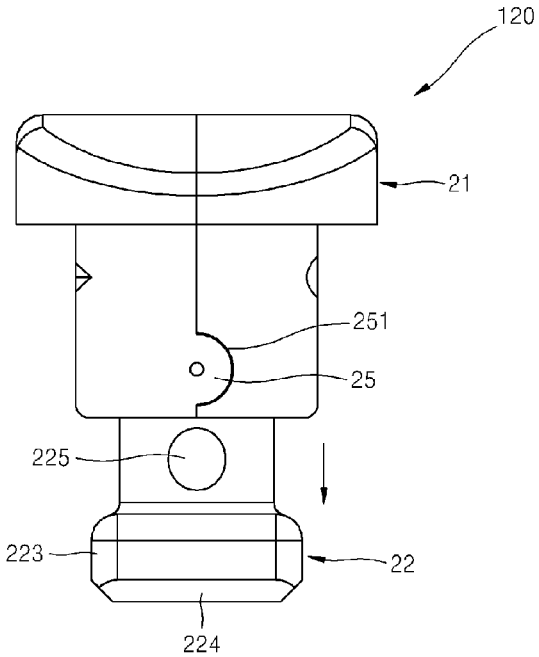
FIG. 23 is a view illustrating a state where the coupling member of the locking unit of FIG. 21 protrudes downward.
Figure 24:
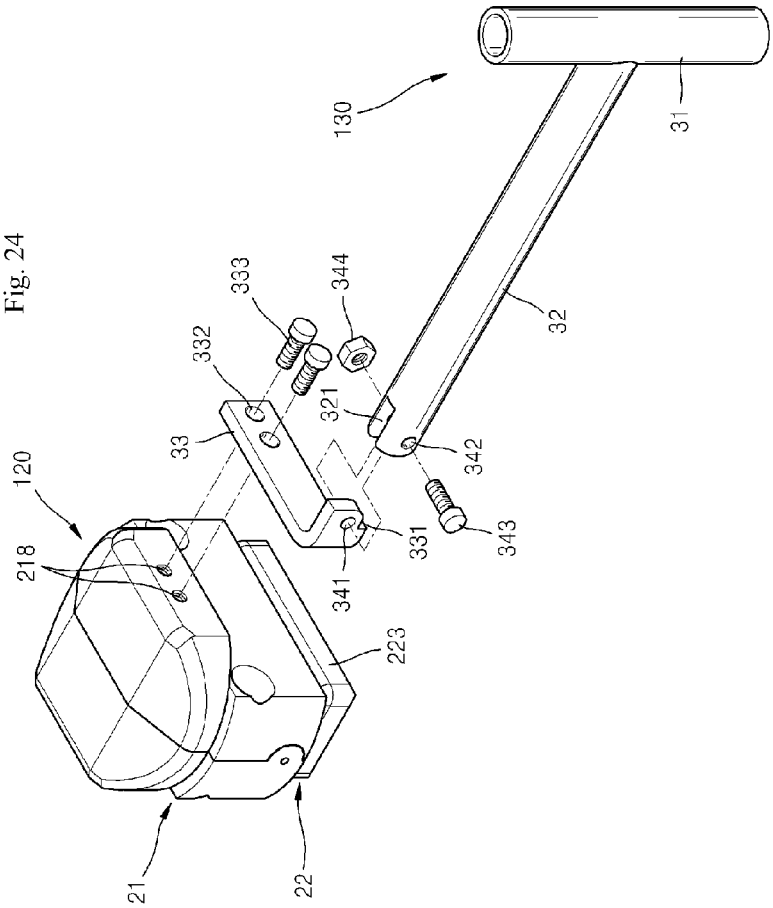
FIG. 24 is an exploded perspective view of a handle of the container according to another exemplary embodiment of the present invention.
Figure 25:
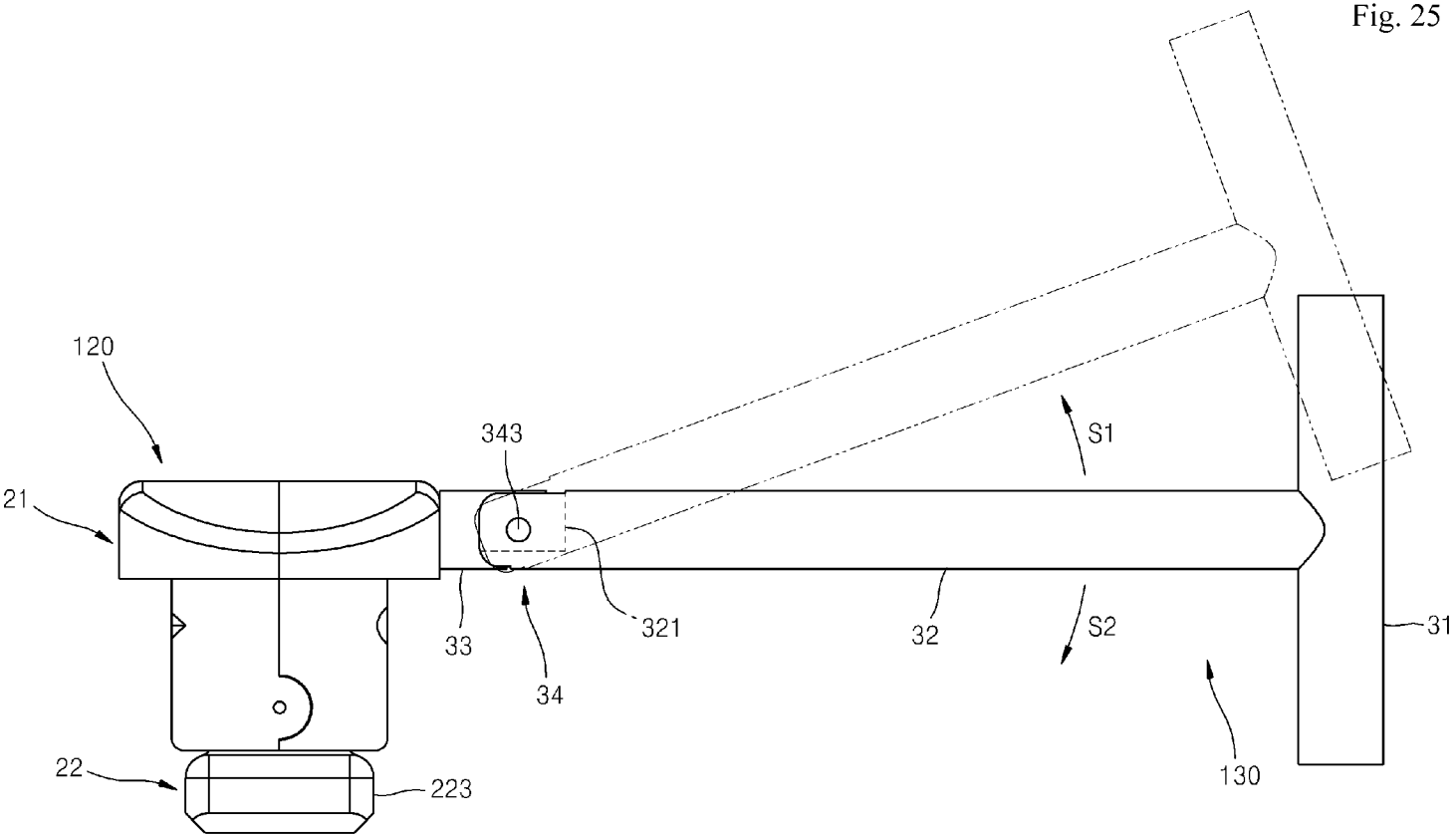
FIG. 25 is a view for explaining a state where the handle of FIG. 24 may rotate upward.

FIG. 20 is a view illustrating a locking unit 120 of a container 200 according to another exemplary embodiment of the present invention. A configuration and an effect of the locking unit 120 are almost similar to those of the locking unit 20, and thus the following will focus only on a difference therebetween.

The main body 21 of the locking unit 120 includes one pair of housing members 21*a* and 21*b* having the cut surfaces 215 that face each other as shown in FIG. 20, and is formed as the housing members 21*a* and 21*b* are screwed with each other by using screws (not shown) that pass through screw holes 26 that are formed in the housing members 21*a* and 21*b* so that the cut surfaces 215 face each other.

The head receiving groove 211 of the locking unit 120 is formed so that the head 221 vertically reciprocates.

The connector receiving hole 214 of the locking unit 120 is formed so that the connector 222 vertically reciprocates.

Accordingly, the coupling member 22 of the locking unit 120 may move linearly reciprocally along the central axis C between an insertion position at which the coupling member 22 is introduced into the main body 21 and a protrusion position at which the coupling member 22 protrudes downward by a preset interval from the main body 21.

The pressing ball receiving grooves 225 are formed in the connector 222 of the locking unit 120 to be vertically arranged in two rows.

That is, four pressing ball receiving grooves 225 are formed at intervals of 90° along an outer circumferential surface of an upper end portion of the connector 222, and two pressing ball receiving grooves 225 are formed at intervals of 180° along an outer circumferential surface of a lower end portion of the connector 222.

Two of the four pressing ball receiving grooves 225 at the upper end portion are disposed parallel to the central axis P2 of the coupling portion 223, unlike in FIG. 17. That is, the angle α1 of FIG. 17 is 0° in the present exemplary embodiment.

The two pressing ball receiving grooves 225 at the lower end portion are spaced apart downward by a preset interval from the four pressing ball receiving grooves 225 at the upper end portion, and are disposed parallel to the central axis P2 of the coupling portion 223 as shown in FIG. 20.

The pressing balls 23 are spherical members respectively received in the six pressing ball receiving grooves 225.

Accordingly, the coupling member 22 of the locking unit 120 has a structure in which a vertical position along the central axis C may be fixed at the insertion position and the protrusion position.

One pair of position fixing projections 216 that project from the left and right of an upper end portion of the cut surface 215 of the housing member 21*a*, and position fixing grooves 217 that are is concave and into which the position fixing projections 216 are inserted are formed in the left and right of an upper end portion of the cut surface 215 of the housing member 21*b*.

The caps 25 of the locking unit 120 integrally project from the cut surface 215 of the housing member 21*a*, and cap receiving grooves 251 that have corresponding shapes to receive the caps 25 are formed in the cut surface 215 of the housing member 21*b*. The cap receiving grooves 251 in the present exemplary embodiment are provided in both end portions of the pressing ball moving holes 212 that are formed in the housing member 21*b*.

Figure 28:
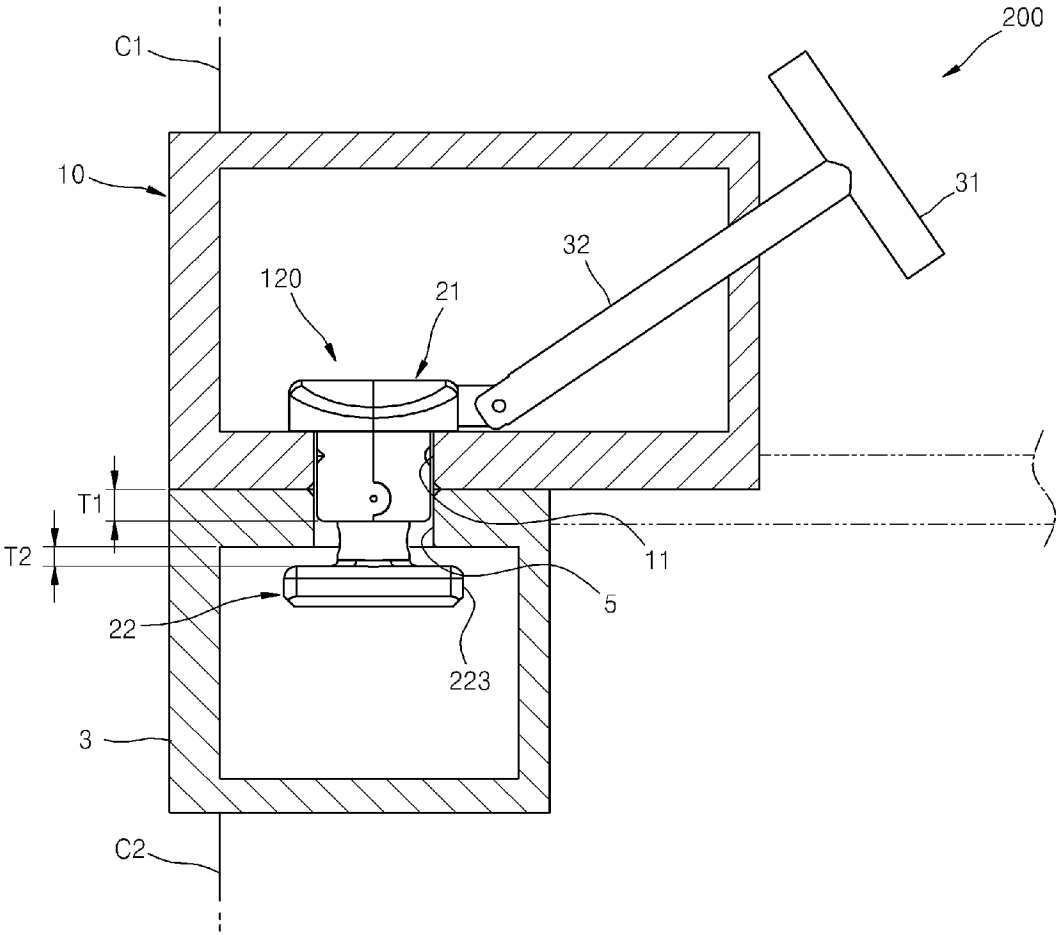
FIG. 28 is a view illustrating a state where a rotation position of the coupling member of the locking unit of FIG. 20 is fixed at the locked position.

Also, the main body 21 of the locking unit 120 has a preset vertical length so that when the coupling member 22 is located at the locked position, at least a part of the coupling member 22 is unrotatably inserted into the insertion hole 5 of the corner member 3 of the lower container C2, as shown in FIGS. 11 and 28.

For example, as shown in FIG. 28, when the coupling member 22 is located at the locked position, since a vertical gap T2 between a top surface of the coupling portion 223 and a lower end of the insertion hole 5 is less than a vertical gap T1 between a lower end surface of the main body 21 and an upper end of the insertion hole 5, even though a transport vehicle is shaken, a state in which the main body 21 is always unrotatably inserted into the insertion hole 5 of the corner member 3 may be maintained.

Also, when the coupling member 22 is located at the locked position, the main body 21 of the locking unit 120 may maintain contact with an inner circumferential surface of the bottom hole 11 of the corner member 10 of the upper container C1 and with an inner circumferential surface of the insertion hole 5 of the corner member 3 of the lower container C2.

A handle 130 of the container 200 includes the holding portion 31, the extending portion 32, the terminal portion 33, and the articulated joint portions 34.

The holding portion 31 of the handle 130 that is a straight member held by the worker's hand is disposed outside the corner member 10.

The extending portion 32 of the handle 130 that is a straight long rod member has one end portion that is connected to a central portion of the holding portion 31.

The terminal portion 33 of the handle 130 that is a "L"-shaped rod member has one end portion that is connected to the other end portion of the extending portion 32 and the other end portion that is coupled by using fixing screws 333 to an upper end portion of the main body 21 of the locking unit 120.

The fixing screws 333 that pass through through-holes 332 formed in the terminal portion 33 are screwed into handle coupling holes 218 formed in an upper end portion of the housing member 21*b*.

The articulated joint portions 34 that are hinge structures that may be freely bent are respectively disposed at connection points of the extending portion 32 and the terminal portion 33, and include a first joint hole 341 that is formed in the terminal portion 33, a second joint hole 342 that is formed in the other end portion of the extending portion 32, an articulated joint portion male screw 343 that passes through the first joint hole 341 and the second joint hole 342, and an articulated joint portion female screw 344 that is screwed with the articulated joint portion male screw 343.

A first anti-rotation portion 331 that is a "Γ"-shaped protrusion is formed on a bottom surface of one end portion of the terminal portion 33, and a second anti-rotation portion 321 that is a "⌋"-shaped protrusion engaged with the first anti-rotation portion 331 is formed on the other end portion of the extending portion 32.

Due to the first anti-rotation portion 331 and the second anti-rotation portion 321, the articulated joint portions 34 are formed so that the holding portion 31 of the handle 130 may rotate upward, that is, counterclockwise S1, with respect to the articulated joint portions 34 and may not rotate downward, that is, clockwise S2, with respect to the articulated joint portions 34.

Since the coupling member 22 of the locking unit 120 in the container 200 constructed as described above may reciprocate along the central axis C between the insertion position at which the coupling member 22 is introduced into the main body 21 and the protrusion position at which the coupling member 22 protrudes from the main body 21, a height of the locking unit 120 that is located at the storage position may be reduced, and thus a height of the corner member 10 may be reduced. Accordingly, since the container 200 does not need to use a separate triangular reinforcing plate (not shown) when attaching the corner member 10 to a lower corner of the container 200, an opening in which a container door is mounted is not closed by the triangular reinforcing plate and thus a size of loaded cargo is not limited and the cargo may be easily loaded and unloaded.

Also, since a position (referred to as a reciprocation position) of the coupling member 22 of the locking unit 120 which reciprocates along the central axis C in the container 200 may be fixed at the insertion position and the protrusion position due to the pressing balls 23, the springs 24, and the pressing ball receiving grooves 225, the worker may easily move the coupling member 22 to the insertion position or the protrusion position by pushing downward or upward the coupling member 22 with his/her hand.

Also, since the main body 21 in the container 200 includes the one pair of housing members 21*a* and 21*b* having the cut surfaces 215 that face each other, the position fixing projections 216 project from one of the cut surfaces 215, and the position fixing grooves 217 that are concave and into which the position fixing projections 215 are inserted are formed in the remaining cut surface 215, the housing members 21*a* and 21*b* may be easily assembled and a vertical shearing force that is greater than a shearing force that may be supported by screws inserted into the screw holes 26 may be borne.

Also, when the coupling member 22 is located at the locked position and the main body 21 is unrotatably inserted into the bottom hole 11 of the corner member 10, since the main body 21 is also unrotatably inserted into the insertion hole 5 of the lower container C2 in the container 200, even though the transport vehicle is shaken, a state in which the two adjacent containers, that is, the upper and lower containers C1 and C2, are firmly fastened to each other may be maintained due to the main body 21.

Also, when the coupling member 22 is located at the locked position and the main body 21 is unrotatably inserted into the bottom hole 11 of the corner member 10, since the main body 21 maintains contact with the inner circumferential surface of the bottom hole 11 of the corner member 10 and with the inner circumferential surface of the insertion hole 5 of the lower container C2 in the container 200, even though the transport vehicle is shaken, a state in which the one pair of containers, that is, the upper and lower containers C1 and C2, are firmly fastened to each other without horizontally moving with respect to each other may be maintained.

Also, since the pressing ball receiving grooves 225 that are spaced apart by a preset angle along the central axis C are formed in an outer circumferential surface of the coupling member 22, and the container 200 includes: the pressing balls 23 that are spherical members for pressing the outer circumferential surface of the coupling member 22, are disposed to reciprocate along the pressing ball moving holes 212 formed in the main body 21, and may be received in the pressing ball receiving grooves 225; the springs 24 that are elastic members for elastically biasing the pressing balls 23 toward the outer circumferential surface of the coupling member 22; and the caps 25 that are members for closing the outer end portions of the pressing ball moving holes 212, the rotation position of the coupling member 22 may be fixed at the locked position and a structure in which the reciprocation position along the central axis C may be fixed at the insertion position and the protrusion position may be easily realized.

Also, since the caps 25 in the container 200 project from the cut surface 215 of the housing member 21*a* and the cap receiving grooves 251 in which the caps 25 are received are formed in the cut surface 215 of the housing member 21*b*, like with the position fixing projections 215 and the position fixing grooves 217, the housing members 21*a* and 21*b* may be easily assembled and a vertical shearing force that is greater than a vertical shearing force that may be supported by screws inserted into the screw holes 26 may be borne.

Figure 26:
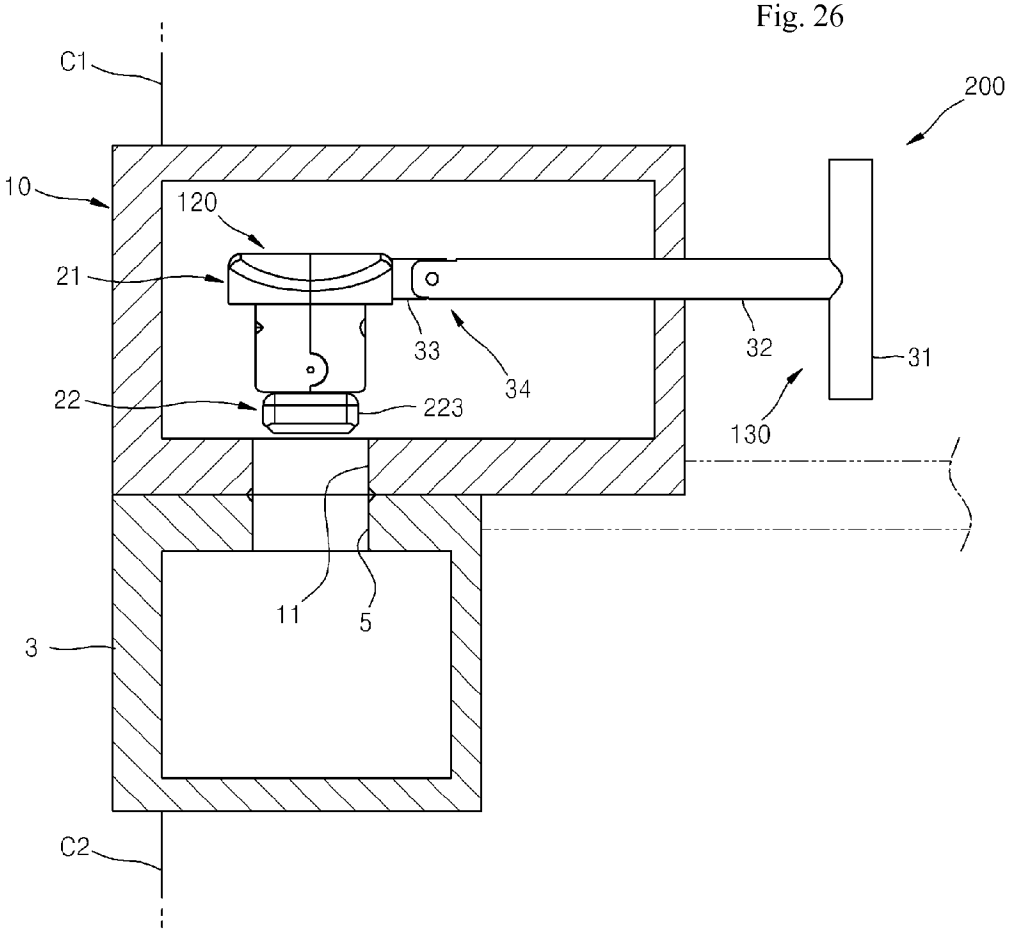
FIG. 26 is a view illustrating a state where the locking unit of FIG. 20 moves leftward in the inner space of the corner member.
Figure 27:
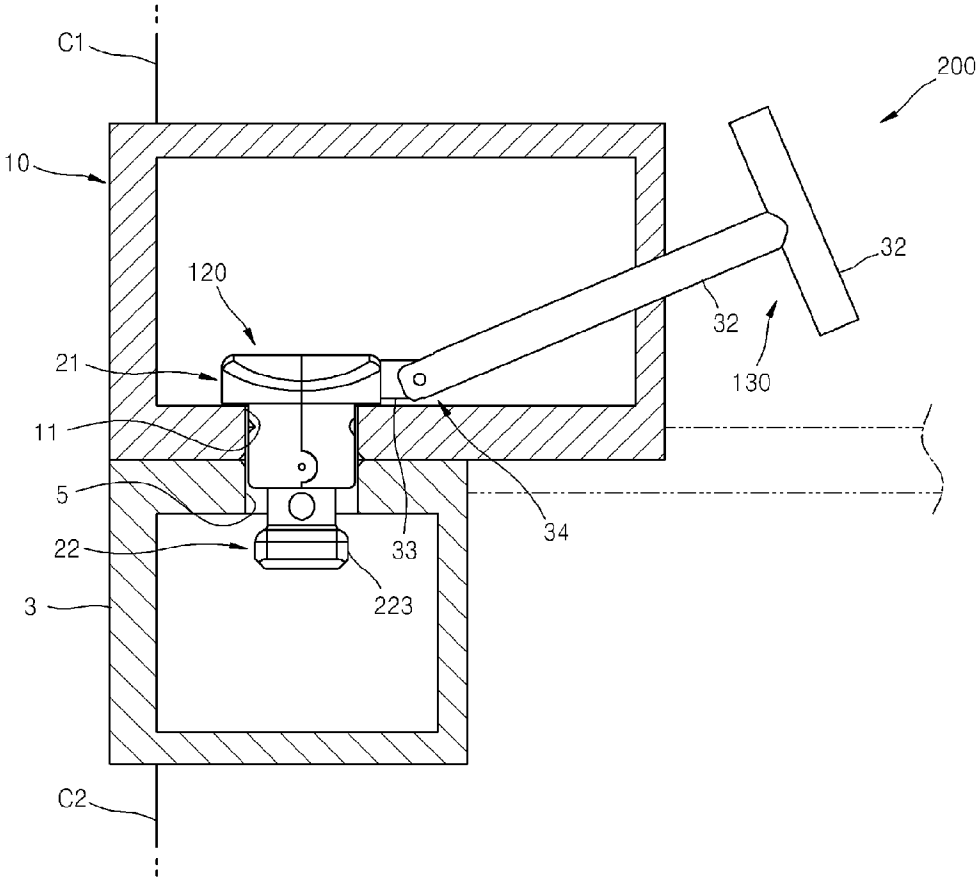
FIG. 27 is a view illustrating a state where the locking unit of FIG. 20 protrudes downward through the bottom hole.

Also, since one end portion of the handle 130 in the container 200 is coupled to an upper end portion of the locking unit 120 and the other end portion of the handle 130 is formed so that the handle 130 may rotate upward, that is, counterclockwise S1, with respect to the articulated joint portions 34 and may not rotate downward, that is, clockwise S2, with respect to the articulated joint portions 34, when the locking unit 120 is horizontally moved leftward in the inner space 13 of the corner member 10 by using the handle 130 as shown in FIG. 26, the locking unit 120 may be stably horizontally moved without being tilted leftward.

While the present invention has been particularly shown and described with reference to exemplary embodiments thereof, they are provided for the purposes of illustration and it will be understood by those of ordinary skill in the art that various modifications and equivalent other embodiments can be made from the present invention.

The invention claimed is:

1. A container for transporting cargo, the container comprising:

a corner member that is disposed at a lower corner of the container and comprises an inner space and a bottom hole that is formed in a lower end portion of the corner member to communicate with the inner space; and a locking unit that is used to fasten two adjacent containers when a plurality of the containers are stacked in multiple stages, is movable between a storage position at which the locking unit is stored in the inner space of the corner member and a use position at which the locking unit protrudes to the outside through the bottom hole of the corner member, and fastens the two adjacent containers at the use position;

wherein the locking unit comprises:

a main body that is unrotatably inserted into the bottom hole of the corner member; and a coupling member having one end portion that is rotatably mounted on the main body and the other end portion that, when inserted into an insertion hole of an adjacent container, is rotatable about a central axis between a locked position at which the other end portion is inseparable from the insertion hole and an unlocked position at which the other end portion is separable from the insertion hole, wherein rotation of the coupling member is fixed at the locked position wherein the main body comprises one pair of housing members having cut surfaces that face each other, wherein a position fixing projection projects from one of the cut surfaces and a position fixing groove that is concave and into which the position fixing projection is inserted is formed in the remaining cut surface.

2. The container of claim 1, further comprising a handle having one end portion that is coupled to the locking unit and the other end portion that is disposed outside the corner member.

3. The container of claim 2, wherein the handle comprises at least one articulated joint portion so that the handle is freely bendable.

4. The container of claim 3, wherein one end portion of the handle is coupled to an upper end portion of the locking unit, and the other end portion of the handle is formed so that the handle rotates upward with respect to the at least one articulated joint portion and does not rotate downward with respect to the at least one articulated joint portion.

5. The container of claim 2, further comprising a position fixing unit for fixing a position of the locking unit that is located at the storage position.

6. The container of claim 5, wherein the position fixing unit comprises:

a first fixing portion that is a groove formed in the corner member; and a second fixing portion that is a cut portion formed on a handle to be detachably coupled to the first fixing portion.

7. The container of claim 1, wherein inclined surfaces are formed on the other end portion of the coupling member so that the coupling member is easily inserted into the insertion hole of the adjacent container.

8. The container of claim 1, wherein the coupling member is formed so that when the locking unit is located at the use position, the other end portion of the coupling member that protrudes to the outside through the bottom hole of the corner member is not re-inserted into the inner surface of the corner member through the bottom hole of the corner member.

9. The container of claim 8, wherein rotation of the coupling member is fixed at a point between the locked position and the unlocked position.

10. The container of claim 1, further comprising an opening through which the locking unit is inserted into the inner space of the corner member.

11. The container of claim 1, wherein the coupling member can move reciprocally along the central axis between a retracted position at which a coupling portion is close to the main body and an extended position at which the coupling portion protrudes downwardly and extends away from the main body.

12. The container of claim 11, wherein a position of the coupling member along the central axis is fixed at the retracted position and the extended position.

13. The container of claim 1, wherein when the coupling member is located at the locked position and the main body is unrotatably inserted into the bottom hole of the corner member, the main body is unrotatably inserted into the insertion hole of the adjacent container.

14. The container of claim 13, wherein when the coupling member is located at the locked position and the main body is unrotatably inserted into the bottom hole of the corner member, the main body maintains contact with an inner circumferential surface of the bottom hole of the corner member and with an inner circumferential surface of the insertion hole of the adjacent container.

15. The container of claim 1, wherein pressing ball receiving grooves that are spaced apart from one another by a preset angle along the central axis are formed in an outer circumferential surface of the coupling member, wherein the container further comprises:

pressing balls that are spherical members for pressing the outer circumferential surface of the coupling member, are disposed to move reciprocally along pressing ball moving holes that are formed in the main body, and can be received in the pressing ball receiving grooves;

springs that are elastic members for elastically biasing the pressing balls toward the outer circumferential surface of the coupling member; and caps that are members for closing outer end portions of the pressing ball moving holes.

16. The container of claim 15, wherein the main body comprises one pair of housing members having cut surfaces that face each other, wherein the caps project from the cut surface of one of the one pair of housing members, and cap receiving grooves in which the caps are received are formed in the cut surface of the remaining housing member.

* * * * *